US006732424B2

(12) United States Patent
Nadicksbernd

(10) Patent No.: US 6,732,424 B2
(45) Date of Patent: May 11, 2004

(54) WORKING CHAMBER SYSTEM AND SEAL DEVICE

(75) Inventor: Reinhard Nadicksbernd, Ochtrup (DE)

(73) Assignee: Schlick Roto-Jet Maschinenbau GmbH, Metelen (DE)

( * ) Notice: Subject to any disclaimer, the term of this patent is extended or adjusted under 35 U.S.C. 154(b) by 111 days.

(21) Appl. No.: 10/125,142

(22) Filed: Apr. 17, 2002

(65) Prior Publication Data

US 2002/0159868 A1 Oct. 31, 2002

(30) Foreign Application Priority Data

Apr. 25, 2001 (DE) ..... 101 20 473
Dec. 20, 2001 (DE) ..... 101 62 780

(51) Int. Cl.[7] ..... B23P 21/00
(52) U.S. Cl. ..... 29/722; 451/89; 118/733
(58) Field of Search ..... 29/722; 312/1; 34/242; 134/200; 451/89; 118/733; 901/31, 39

(56) References Cited

U.S. PATENT DOCUMENTS 4,141,609 A * 2/1979 Eisert ..... 312/1
4,162,196 A * 7/1979 Folsom et al. ..... 312/1
4,556,471 A * 12/1985 Bergman et al. ..... 118/733
5,090,782 A * 2/1992 Glachet et al. ..... 312/1
5,460,439 A * 10/1995 Jennrich et al. ..... 312/1
2004/0005847 A1 * 1/2004 Dangel ..... 451/89

FOREIGN PATENT DOCUMENTS

DE 100 07 831 2/2000
DE 100 62 133 12/2000

* cited by examiner

*Primary Examiner*—David P. Bryant
(74) *Attorney, Agent, or Firm*—Milde & Hoffberg, LLP

(57) ABSTRACT

A sealing device is provided for a working chamber system with a robot hand (216) that extends into the working chamber (100) through an aperture (120) by means of which a seal may be established and removed by remote control. The sealing device includes: (a) a flexible sealing element (20) by means of which an inner pass-through ring element (40) is connected with the edge of the aperture (120); (b) at least two coupling elements that are attached to the pass-through ring element (40) and (c) at least one locking element that is connected with the robot hand (216) and that may be positioned by means of positioning elements for coupling of the robot hand (216) with the pass-through ring element (40) by means of the coupling elements.

23 Claims, 13 Drawing Sheets

WORKING CHAMBER SYSTEM AND SEAL DEVICE

BACKGROUND OF THE INVENTION

The invention relates to a working chamber system consisting of

A working chamber wall with at least one aperture,

A robot hand extending through the aperture into the working chamber, and

A sealing device by means of which a seal of the aperture may be established and removed by remote control with respect to the extending robot hand.

German Patent Applications Nos. 100 62 133.3 and 100 07 831.1 disclose generic working chamber systems in which a robot hand or other manipulator arm extends into a working chamber through a pass-through tube installed in an aperture. An inflatable bellows surrounds the robot hand and seals it with respect to the pass-through tube. Subsequently, the bellows again relaxes by release of the pressurizing gas so that the robot hand may be withdrawn from the pass-through tube and thus from the working chamber along with potential gripped work material.

Such working chamber systems have proven themselves. A particular advantage is the fact that a secure seal may be established and removed in the pass-through tube automatically, i.e., without installation activities or other manual contact. Thus, the robot hand may be moved during operation while maintaining the seal within the pass-through.

Individual workpieces may be inserted into the working chamber and the seal may be established automatically, e.g., by means of a procedure progression program, immediately before the work process begins within the chamber. Contact by operating personnel is not required. After the end of the work procedure within the chamber, the seal at the pass-through tube may again be removed by remote control, so that the robot hand is free to move, and may be removed from the chamber with the work material.

The working chambers enable movement of the robot hand lying in the sealed pass-through tube with several degrees of freedom.

It has been shown, however, that inflation of the sealing bellows and the subsequent release of air or pressurizing gas requires too much time in certain work processes.

SUMMARY OF THE INVENTION

A principal object of the present invention is to further develop a working chamber system of the type described above to the point that the establishment and subsequent removal of a sealed connection between the robot hand and the working chamber may be effected as quickly possible.

This object, as well as further objects which will become apparent from the discussion that follows, are achieved, in accordance with the invention, by providing a sealing device which includes:

(a) a flexible sealing element through which an inner pass-through ring element is connected with the edge of the aperture;

(b) at least two coupling elements attached to at least one of the pass-through ring element and the robot hand; and (c) at least one locking element connected to at least one of the robot hand and the pass-through element, which locking element may be brought into engagement with the coupling elements by means of positioning elements for the purpose of coupling the robot hand with the pass-through ring element.

In one embodiment, the two coupling elements are attached to the pass-through ring element and the locking element is connected to the robot hand. In a second embodiment, the two coupling elements are attached to the robot hand and the locking element is connected to the pass-through ring element.

End axes of industrial robots, and other manipulators into which a tool holder or processing tool may be attached, are defined herein as a "robot hand".

The robot hand may be introduced without hindrance into the working chamber by means of the working chamber system based on the invention, and may be extracted again after completion of work. Thus, the work piece may be transported through the pass-through ring element as long as the circumference of the work piece is smaller than the inner diameter of the pass-through ring element. For this, the robot and its robot hand and any work-material gripper mounted on it moves in a traverse direction through the pass-through ring element into the working chamber. By means of positioning elements, preferably linear motors or pneumatic cylinders that are positioned either on the working chamber or the robot, the locking elements mounted on them are brought close to the coupling elements, and then in contact with the coupling elements, by means of which a fixed connection is established between the pass-through ring element in the working chamber and the robot hand. This coupling is released again by return traverse of the positioning elements. This effect is achieved regardless of whether the coupling elements are mounted on the pass-through ring element and the positioning elements and locking elements are mounted on the robot hand or vice versa.

It is further advantageous if at least one bracket, to hold the pass-through ring element in an initial position, is mounted on the working chamber wall. By means of this, the pass-through ring element is held in a defined initial position so that the robot may assume this position exactly by means of a path control, and may establish the coupling connection with the pass-through ring element.

Locking of the robot hand with the pass-through ring element may be achieved using tie bolts into which fork-shaped locking elements engage.

It may also be formed as a bayonet mount so that the coupling is enabled by rotation of that robot element carrying the locking elements. For this, the coupling elements are preferably formed as studs that include a cylinder area and a front head area that are connected via a radial slot. The positioning elements are formed by at least two locking recesses provided in a coupling receiver flange, each of which surrounds a stud pass-through recess and a locking stud recess connected to it.

Also, coupling using magnetic coupling elements is possible. The coupling elements in this case are electromagnets, and the coupling receiver flange includes ferro-magnetic magnetic coupling areas.

It is also advantageous for the robot hand to include a work piece holder with a screw-clamp-type, U-shaped bail that is provided on its one end with a displaceable clamping element, and on its other end with a supporting element. Such a gripper is preferably mounted on the robot so that the tensioning axis extending between the clamp and the support element extends approximately in the direction of the last robot axis. Thus, the robot hand, the gripper, and the work piece being clamped within it are all so positioned that their narrowest dimensions allow insertion into the interior of the working chamber through the limited width of the pass-through ring element.

A particularly advantageous embodiment of the invention provides:

That the coupling elements (by pushing) are formed of at least one collar edge element that is secured at least in sections about the circumference of the pass-through ring element and that includes a collar edge oriented toward the central point of the pass-through ring element; and That each of the locking elements may be brought into contact with at least one collar edge element by means of positioning elements under the collar edge.

A fixed, friction connection is established between the pass-through ring element and the coupling receiver flange on the robot hand by the locking elements thus provided. This locking is possible at any angle of the coupling receiver flange with respect to the working chamber wall. Thus, it is no longer necessary to bring a 6-axis articulated-arm robot into a certain angled position by means of its fourth axis that is usually a rotation axis for the purposes of locking and sealing. Thus, the fifth axis, an articulated axis, may be inserted into the working chamber in any orientation. It is no longer necessary to provide exact return of the robot hand to a pre-determined locking position during the work process.

In this embodiment example, the locking elements may be formed as sliding locking elements that include an oblique guide that may be inserted at least partially under the chamfered collar edge. The sliding locking elements are mounted, for example, on pneumatic cylinders, and may be inserted under the collar edge element directly by them.

Preferably, in this embodiment example, the coupling elements are each formed as a swiveling locking element with an arc edge that possesses an oblique guide and that may be at least partially swiveled under the oblique guide of the collar edge. By swiveling the swivel locking elements, the return path along the arc edge used during locking is longer than for a chamfered sliding locking element. Therefore, a fixed locking may be achieved using less force, so that the positioning elements may be made smaller. A lever arm is preferably created by means of an eccentric contact point, so that the locking force may be increased further.

Also, the invention includes a seal integrity monitoring device for a working chamber system of the type described above.

With the use of an abrasive blasting medium within the working chamber, the seal element by means of which the robot hand is connected with the working chamber wall is exposed to strong wear, so that cracks may form in the seal element.

A further object of the present invention is to provide a seal integrity monitoring device by means of which a crack in the seal element may be detected early, and leakage of abrasive material from the working chamber may be prevented.

This object is achieved by a seal integrity monitoring device for a working chamber system of the type described above according to a first embodiment example that comprises a two-part seal element that includes a flexible inner liner and a flexible outer shell that are connected at the edges by the formation of an interior container, whereby the interior container includes at least one exit aperture positioned in the lower area of the seal element with at least one particle sensor. If the seal element becomes severely worn, the inner liner rips, while the outer shell prevents release of the abrasive material out of the working chamber that has leaked out of the crack. The blasting medium that has passed through the crack into the inner container moves by gravitational force into the exit aperture at the bottom, and thus out of the inner container. A particle sensor at the exit aperture may sense blasting medium present there, thus automatically registering damage to the seal element. Also, an additional warning function exists for an operator who is not placed into danger by leaking blast material, since the outer shell traps blasting particles until the inner liner is repaired.

A magnetic sensor is advantageously selected as the particle sensor if an iron-based blasting medium is used.

If volatile blasting media, particularly carbon-dioxide pellets, are used, a decrease in local temperature in the area of the exit aperture may be identified using thermal sensors.

An optical sensor similar to a photoelectric beam is suitable for all other blasting media such as sand.

According to a second embodiment example, the aforementioned object is achieved by means of a seal integrity monitoring device comprising a two-part seal element that surrounds a flexible inner liner and a flexible outer shell which are connected at the edges by formation of an air-tight inner container, and a pressure sensor to measure the gas pressure within the inner container. By monitoring the container inner pressure, a crack in the seal element may be identified.

For a full understanding of the present invention, reference should now be made to the following detailed description of the preferred embodiments of the invention as illustrated in the accompanying drawings.

DETAILED DESCRIPTION OF THE PREFERRED EMBODIMENTS

Figure 1:
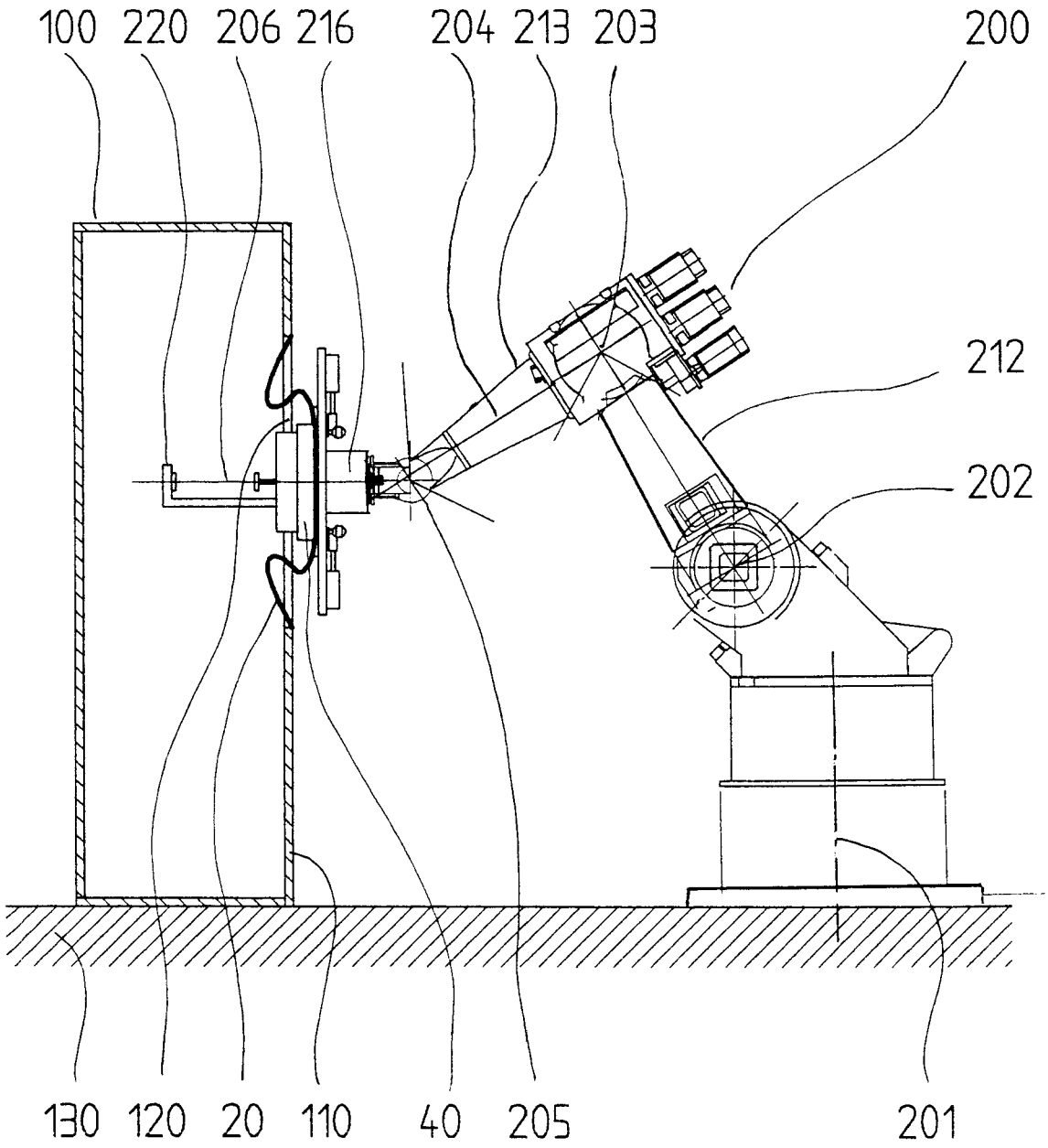
FIG. 1 is a lateral cutaway sectional view of a working chamber with an industrial robot reaching in from without.

The preferred embodiments of the present invention will now be described with reference to FIGS. 1–10 of the drawings. Identical elements in the various figures are designated with the same reference numerals.

FIG. 1 shows a working chamber 100. An industrial robot 200 is positioned outside the working chamber. The industrial robot 200 includes six rotational axes 201, . . . , 206 and thereby six degrees of freedom. The 6-axis kinematics enables access to each point in the chamber in any orientation of the last robot member, such as the robot hand 216 with a work piece holder 220.

The vertical axis 201 is a rotation axis about which the entire industrial robot 200 may rotate with respect to a base 130. Two articulated axes 202, 203 are subsequently arranged, by means of which the so-called upper arm 212 and the lower arm 213 may be inclined. The so-called wrist 205 is another articulated rod above this that may be positioned within the chamber. The orientation of the wrist 205 with respect to the lower arm 213 may also be changed by means of the rotation axis 204.

The robot hand 216 with the processing or tensioning tool mounted on it may be rotated above the hand rotation axis 206, for example with the work piece holder 220. It is provided that the robot hand 216 allows a rotation of the work piece holder 220 without limitation of the rotating angle. Unlimited rotation enables smooth work piece treatment with blasting media and/or paint within the working chamber 100, since, in contrast to limited rotational angles, the dead-center point during direction change is eliminated.

The work piece holder may possess two gripping fingers, or, particularly for round work material, multiple gripping fingers that may be electrically, pneumatically, or hydraulically operable, as is known.

In the working situation depicted in FIG. 1, the wrist 205 and the robot hand 216 with the work piece holder 220 are located within a pass-through ring element 40 passed through the working chamber wall 110, and are firmly attached to it. The attached pass-through ring element 40 acts as an extension of the robot hand 216, and may be rotated, displaced, or tipped by it to the extent that a flexible sealing element 20 surrounding the pass-through ring element 40 will allow.

The pass-through ring element 40 may, for example, be in the form of a circular ring, an elliptical ring, or a rectangular ring. The particular shape, and thereby the cross-section of the aperture 120 and/or the seal element 20 is so selected that it allows the greatest possible freedom of movement in the plane of the working chamber wall 110 for a particular application. A circular ring shape is particularly suitable if the work piece is rotated merely about the robot hand axis 206. More elongated cross-sectional shapes such as ellipses or rectangles are particularly suitable if additional movements of the work piece along the x- or y-axis in the plane of the working chamber wall 110 are required.

Figure 3A:
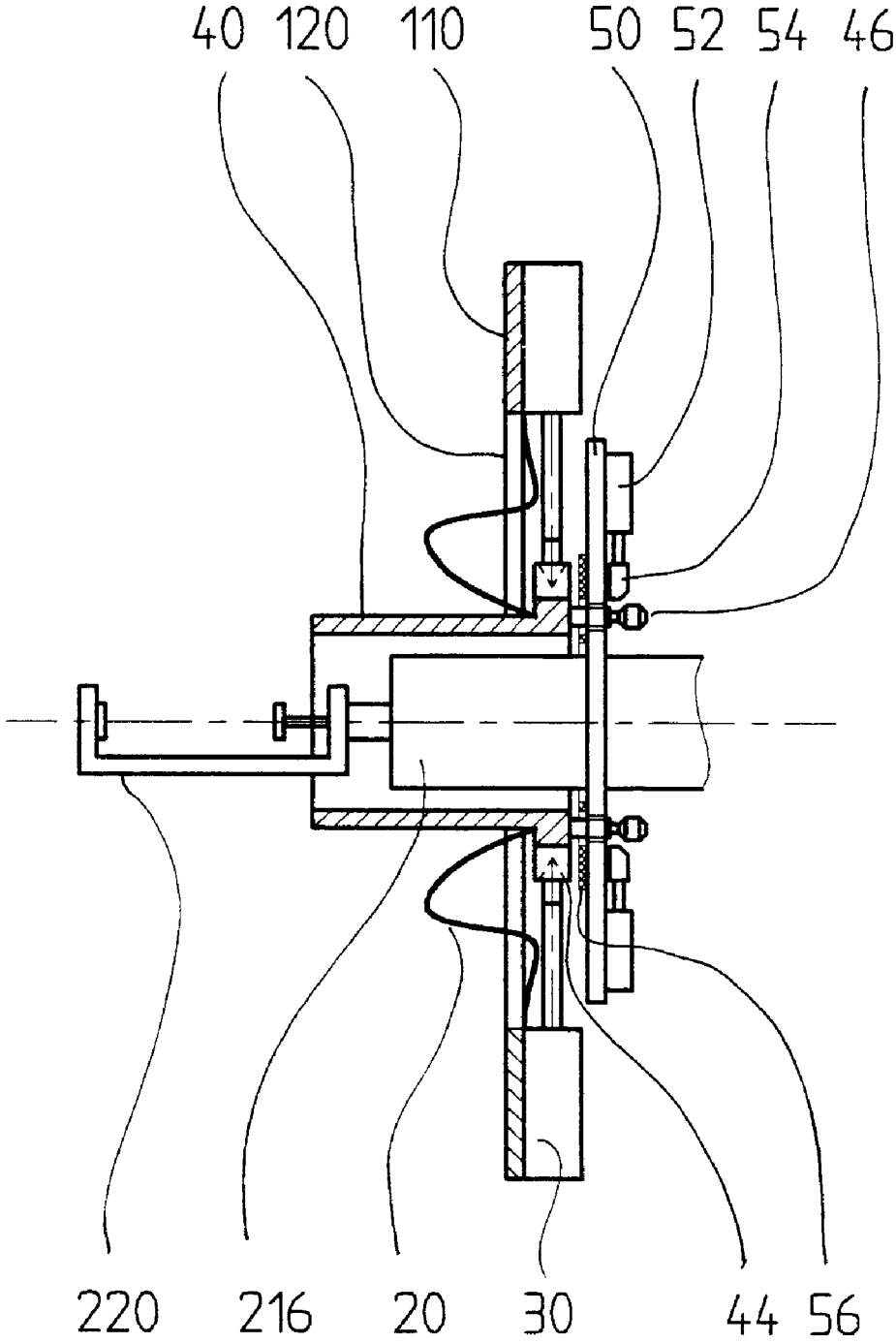
FIGS. 3*a*–3*c* illustrate a first embodiment of a sealing device according to the invention in various positions of the industrial robot in cutaway view.
Figure 3B:
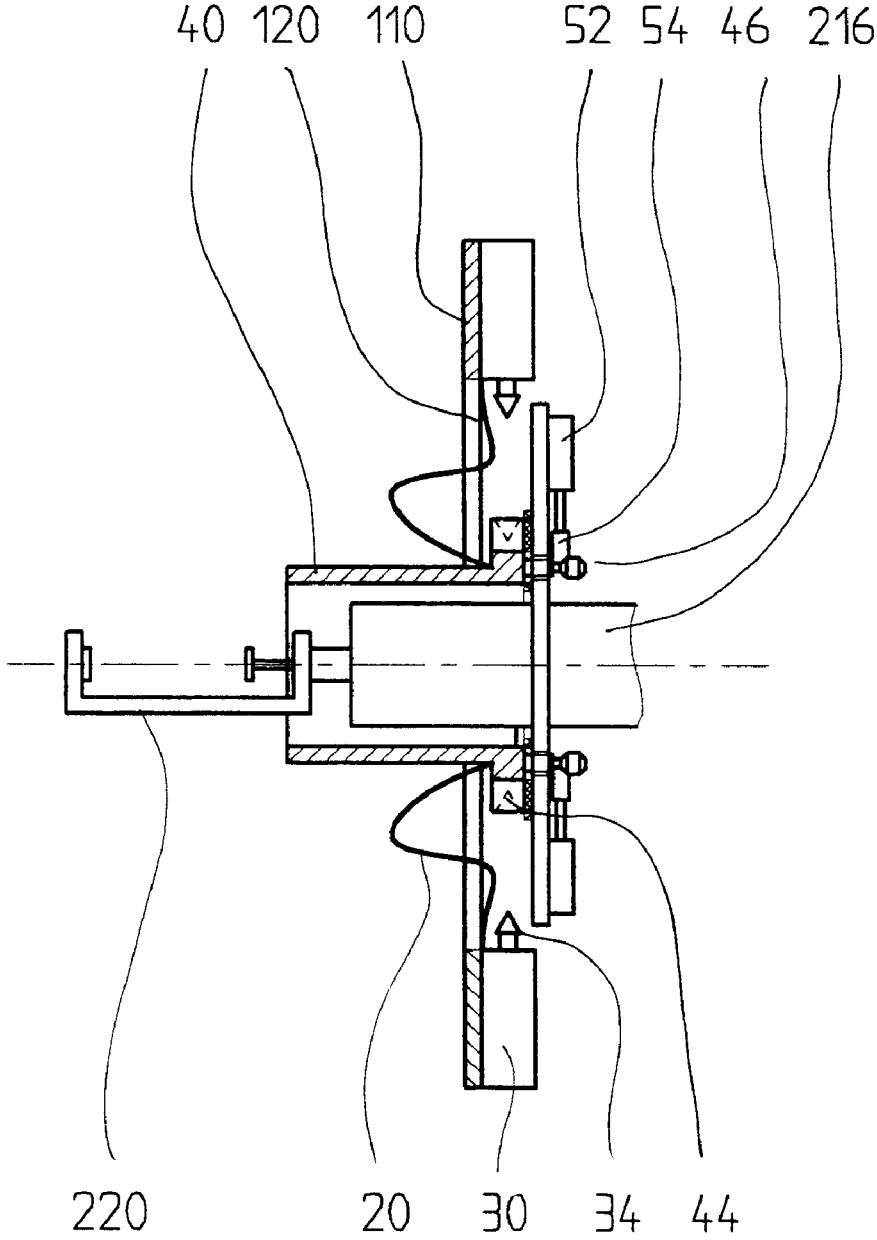
Figure 3C:
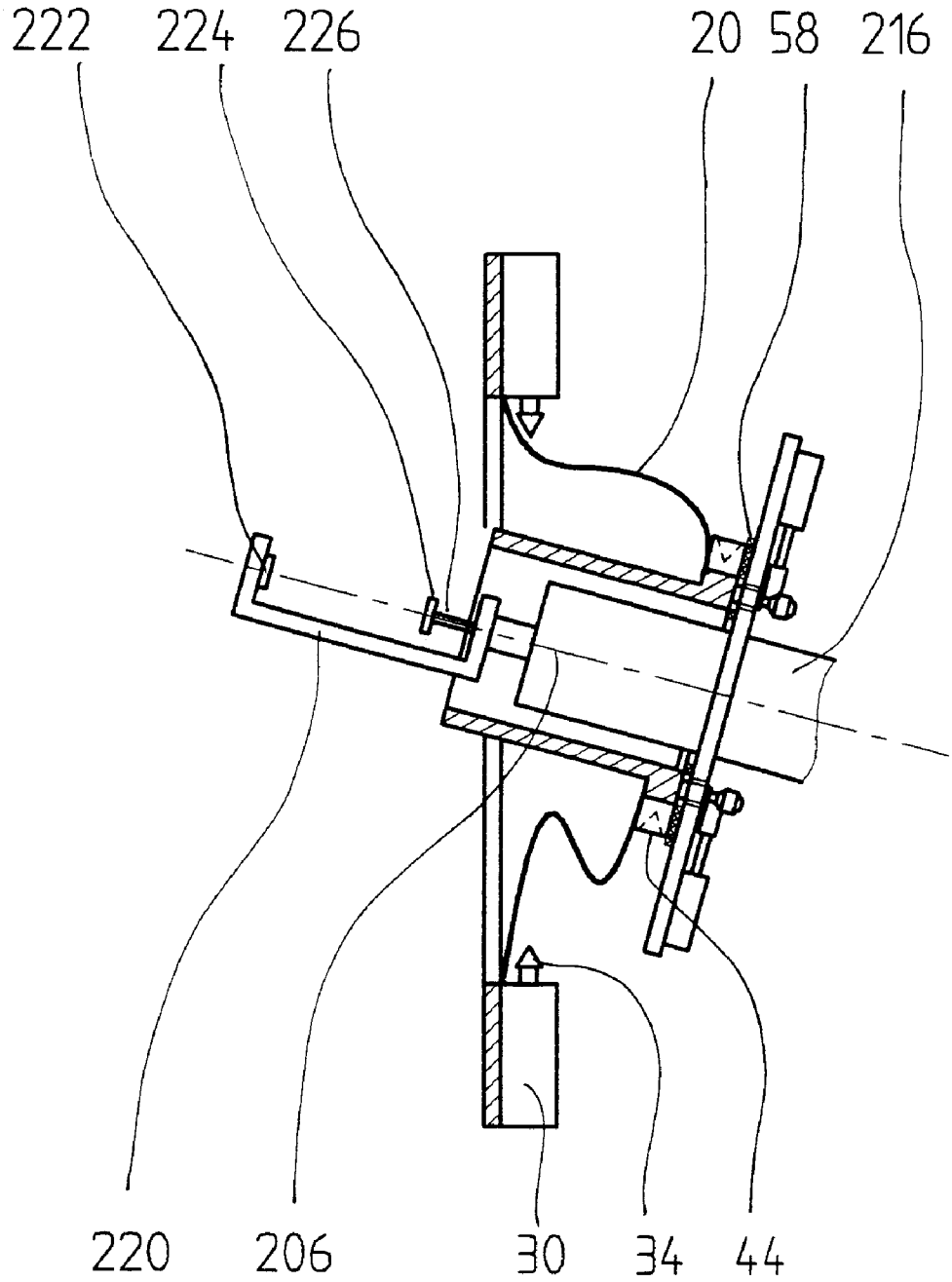

Also, the pass-through ring element 40 may be in the form of a tube. The extension to a pass-through tube, as shown in FIGS. 3*a* through 3*c*, allows protection of the robot hand along with the work piece holder 220 located on it by means of partial screening.

The pass-through ring element 40 is enclosed by this sealing element 20, and connected by means of it with the working chamber wall 110. The sealing element 20 may be formed as a bellows with additional material folds in order to enable greater freedom of movement of the pass-through ring element 40 lying within. It is preferable to roll flat sections of a rubber material into a funnel, which results in very simplified manufacture. It may also be formed, however, from a slightly-expandable ring of an elastomer sheet. Also, circular arcs may be combined by overlapping. If the sealing element 20 is damaged, only one segment need be replaced.

For the purpose of automatic damage diagnosis, the sealing element 20 may be formed as a hollow body that is pressurized with gas. Interior pressure monitoring can identify a pressure loss that may be attributed to damage. Thus, a reaction by operating personnel and/or an automatic control system is possible for the purpose of immediately preventing the loss of medium from the interior of the working chamber 100.

A seal integrity monitoring device (shown in FIG. 10) may be provided for automatic damage diagnosis. This includes a two-part sealing element 20 with a flexible inner lining 22 and a flexible outer shell 21 that are connected at the edges by the formation of an interior container. There is an exit aperture 94 provided in the lower area of the sealing element 20 with at least one particle sensor 96. If blasting medium enters the inner lining 22 via a crack 23, it then makes its way to the exit aperture 94 by gravity, and is detected there optically by the operator, or automatically by a particle sensor 96.

The pass-through ring element 40 has a significantly smaller outer circumference than does the aperture 120 provided in the working chamber wall 110. The relationship of the outer circumference of the pass-through ring element 40 to the inner circumference of the aperture edge is preferably about 1:2 to 1:5 in order to provide the greatest freedom of movement to the robot. The space between is bridged and sealed by the sealing element 20 so that leakage of dirt from the interior of the working chamber 100 is prevented. The distance bridged by the sealing element 20 may be the same all around. A wider flexible sealing element 20 may also be provided in the direction of main motion than in other areas of the circumference.

The aperture 120 and the holding and sealing devices positioned on it may be mounted in any of the walls 110 of the working chamber 100, i.e., either in a sidewall or the ceiling or the floor of the chamber. The function of the coupling and sealing is ensured regardless of position by the working chamber system subject to the invention.

Figure 2A:
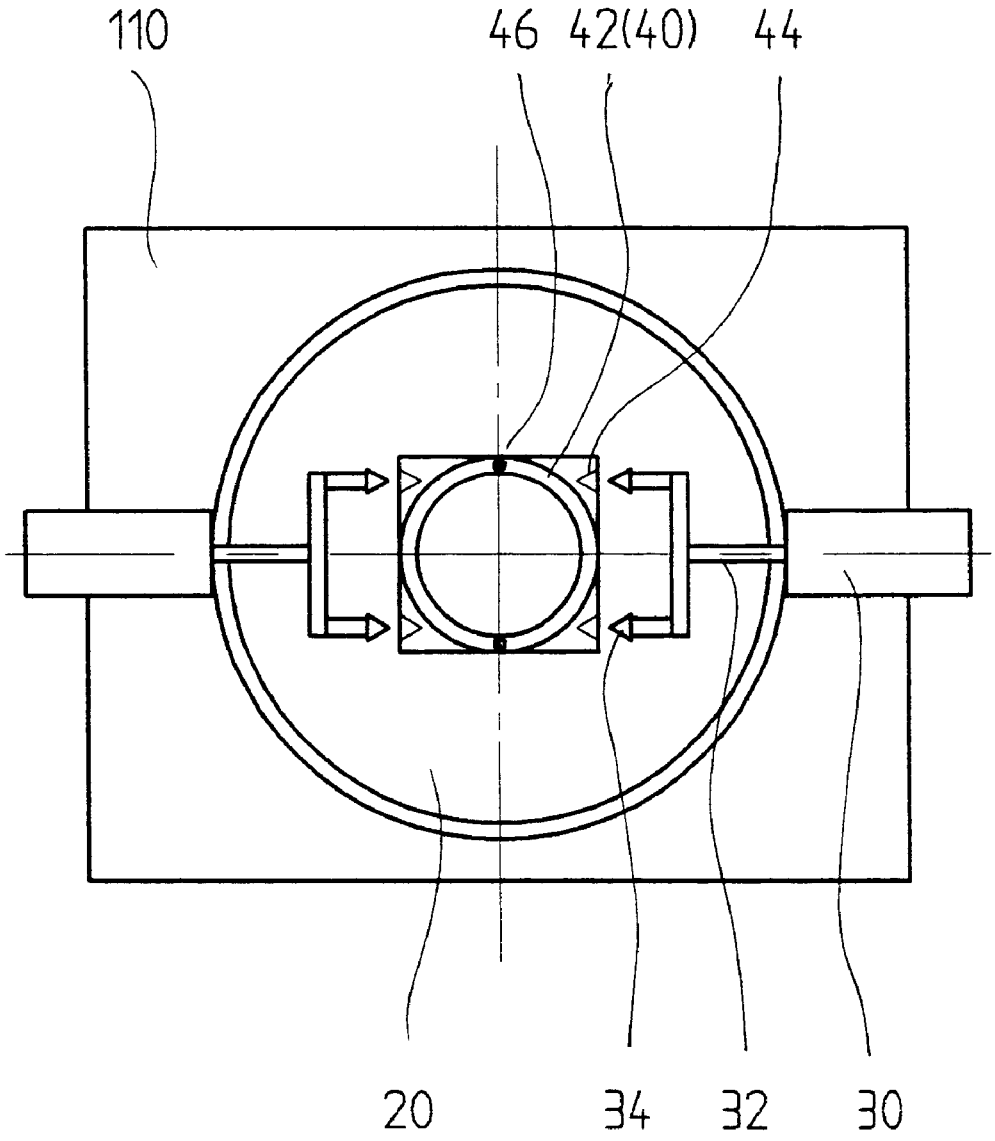
FIGS. 2*a* and 2*b* are front views of a working chamber wall with sealing and bracket devices in various forms.

As FIG. 2*a* particularly shows, in a first embodiment example of the pass-through ring element 40, coupling elements 46 are mounted on a coupling flange 42. The pass-through ring element 40 in all embodiment examples of the invention is preferably held by a securing element in an initial position in which the coupling and decoupling of the robot hand 216 to the pass-through ring element 40 may be automated. The securing element includes at least two actuation elements 30, for example, pneumatic cylinders positioned opposite the aperture 120, with displaceable pushrods 32, on whose ends centering elements 34 are mounted. For this, conical tenons or other shapes may be used.

Receiver elements 44 are positioned on the pass-through ring element 40 with which the compatible centering elements 34 of the securing device engage. As FIG. 3*b* also shows, the centering elements 34 are extracted from the receiver elements 44 after subsequent coupling of the robot hand 216 and pass-through ring element 40. Thus, the pass-through ring element 40 is moveable, and can be displaced, rotated, or swiveled within aperture 120.

Figure 2B:
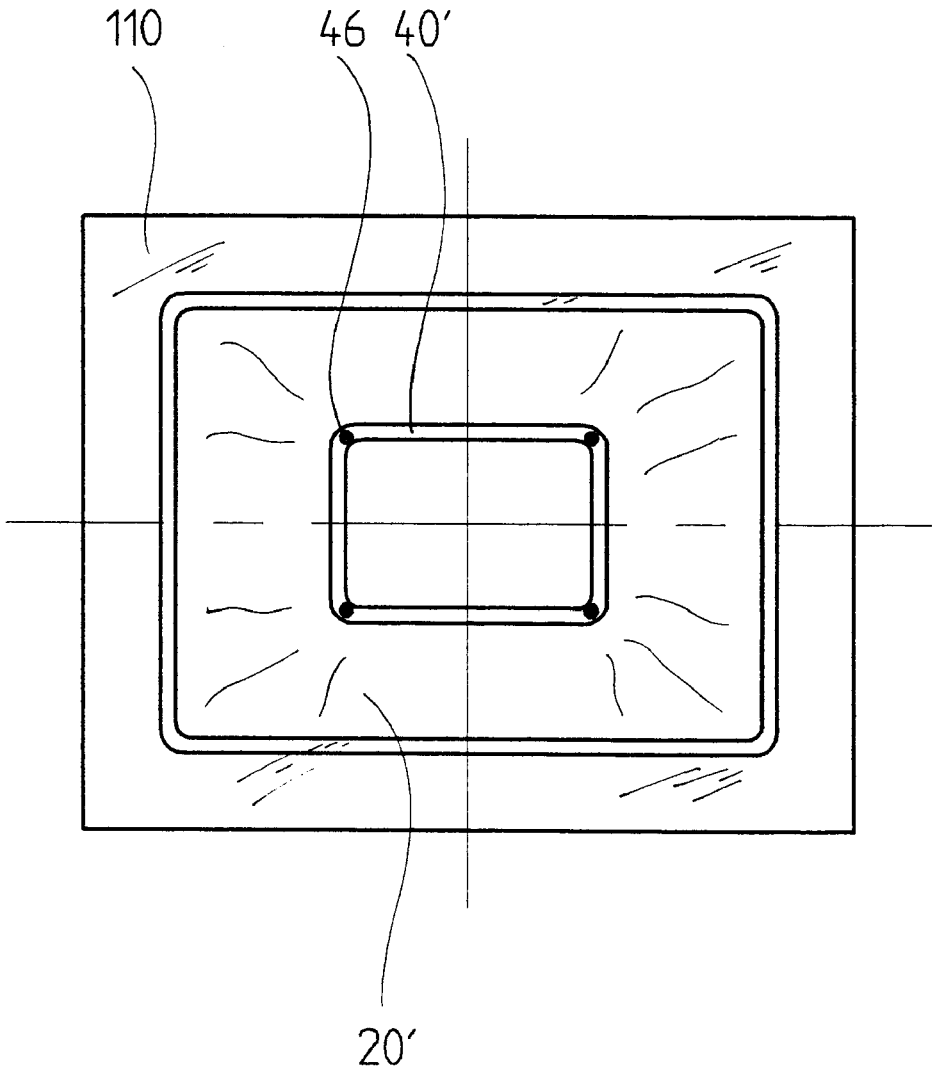

In a light embodiment example of the pass-through ring element 40' shown in FIG. 2*b* and a correspondingly stiff formation of the flexible sealing element 20', the design of the sealing device is self-supporting on the working chamber wall so that the pass-through ring element 40' remains in an initial position without any additional securing device. In the embodiment example shown in FIG. 2*b*, the aperture, the sealing element 20', and the pass-through ring element 40' are rectangular in order to simplify lateral movements of the coupled robot hand 216.

FIG. 3*a* shows the possible initial position of the pass-through ring element 40 within the aperture 120 in the working chamber wall 110 before the coupling with the robot hand 216. The robot hand 216 bears a work piece holder 220. Both may be inserted through the interior of the pass-through ring element 40. As the robot hand 216 and the work piece holder 220 approaches, a coupling receiver flange 50 with its recesses moves over the coupling element 46. Subsequently, the locking elements 54 are engaged with the coupling elements 46 by means of positioning elements 52. The coupling receiver flange may be wheel-shaped, and may include a hub section and a ring section connected by at least two spoke sections. As FIG. 5 particularly shows, the coupling elements 46 are preferably formed as studs that include a cylinder area 46.1 and a front head area 46.3 which are connected via a radial slot 46.2. The transition from the head area 46.3 to the slot 46.2 is provided with an oblique transition guide surface 46.4. The ring elements 54 compatible with this include two parallel, separated fork arms between which the coupling element 46 may be inserted with its slot 46.2. The fork arms are preferably also provided with an oblique transition guide surface.

Figure 6:
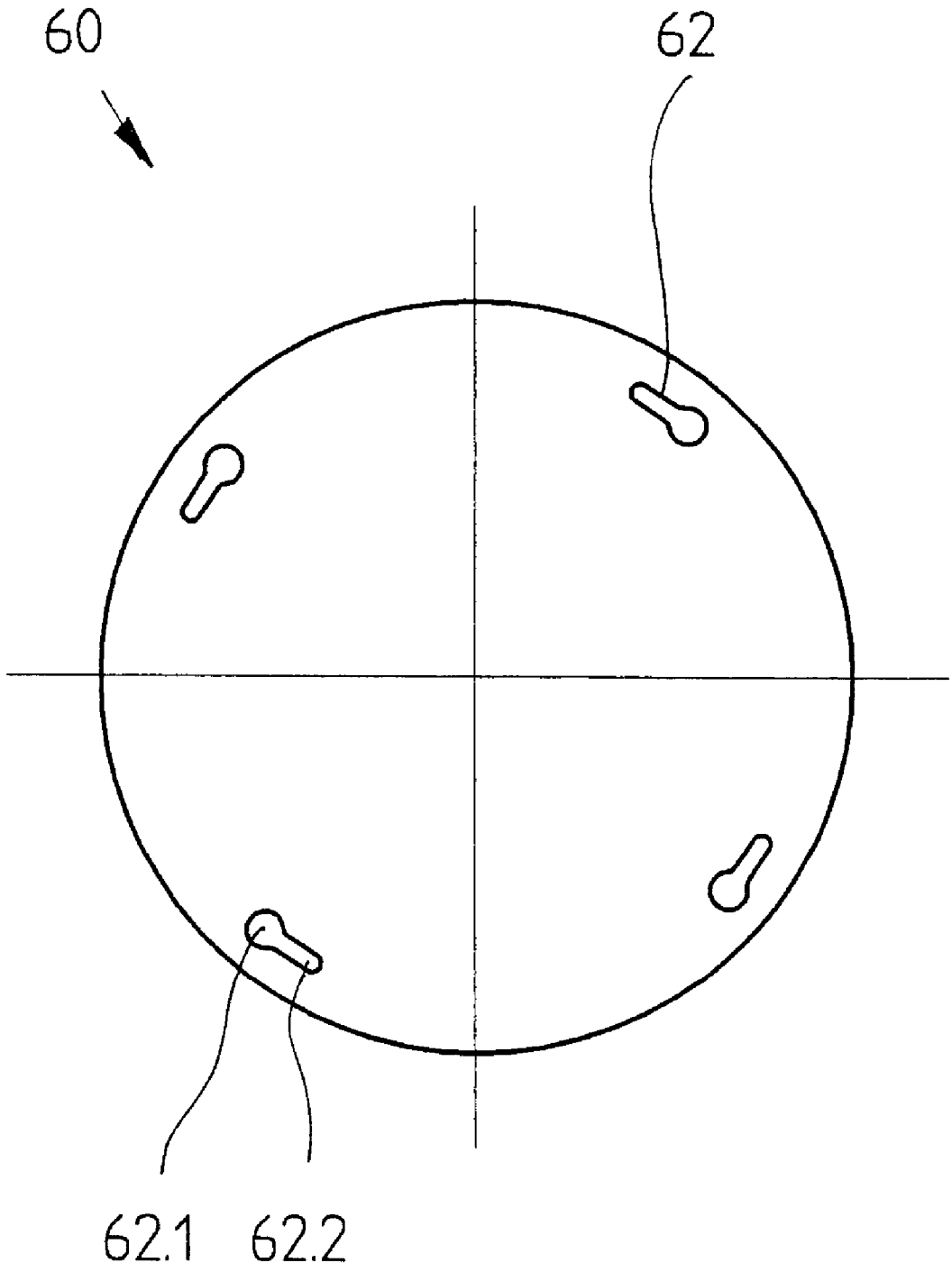
FIG. 6 shows a locking element in front view.

Also, locking using a bayonet mount may be provided. FIG. 6 shows a disk-shaped locking element 60 that includes locking recesses 62. Each of these is composed of a stud pass-through recess 62.1 and a stud locking recess 62.2 connecting to it. As the robot arm and pass-through ring element 40 approach, the stud-shaped coupling element 46 is forced through the stud pass-through recess 62.1 until the ring slot 46.2 (see FIG. 5) lies at the height of the locking elements 60. By means of rotation of the locking element 60, which may be caused by rotation of that particular robot axis bearing the locking element 60, the stud locking recess 62.2 is laterally rotated into the slot area 46.2 of the coupling element 46. This results in a form-shaped connection.

Upon the engaging of the coupling and locking elements with one another, a seal results simultaneously between the robot hand 16 and the pass-through ring element 40. For this, the coupling flange 42 and/or the coupling receiver flange 50 or locking element 60 is at least partially covered with a flexible sealing material 58. It may also be provided with a two-piece labyrinth gasket, whereby a first sealing ring is mounted on the robot and a second sealing ring engaging it is mounted on the pass-through ring element.

The oblique transition guide surfaces on the locking and/or coupling elements on the one hand cause any minor displacement during coupling to be compensated, so that the elements engage smoothly. On the other hand, this causes relative movement of the pass-through ring element 40 and the robot hand 216 with respect to each other, by means of which both parts are pressed against the elastic gasket 58 between them.

In the embodiment example shown in FIG. 3*a*, the coupling receiver flange 50 is attached to the robot hand 216, and the coupling elements 46 are attached to the pass-through ring element [40].

It is just as feasible to position coupling elements 46 on the robot hand 216 and the coupling receiver flange 50 on the pass-through ring element 40.

Figure 4:
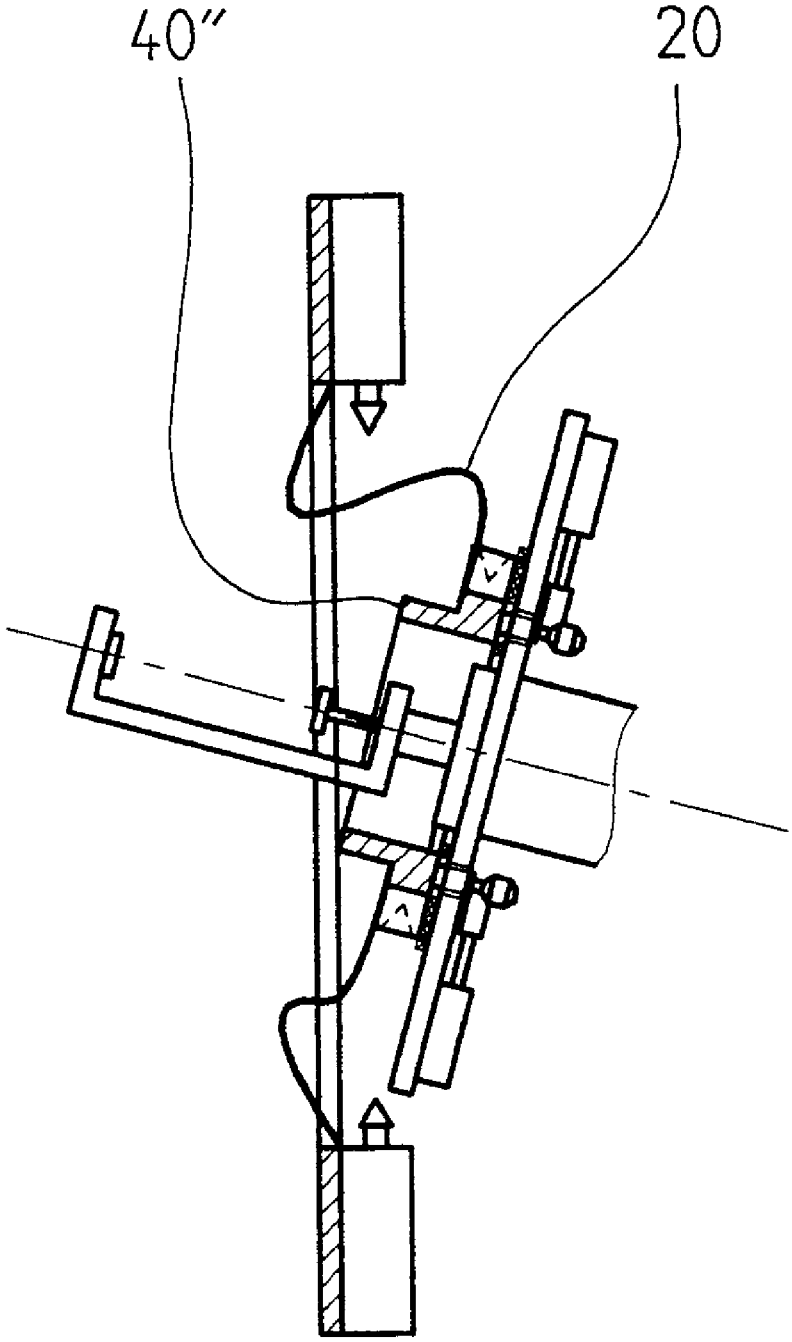
FIG. 4 shows another embodiment of the sealing device according to the invention in cutaway view.
Figure 5:
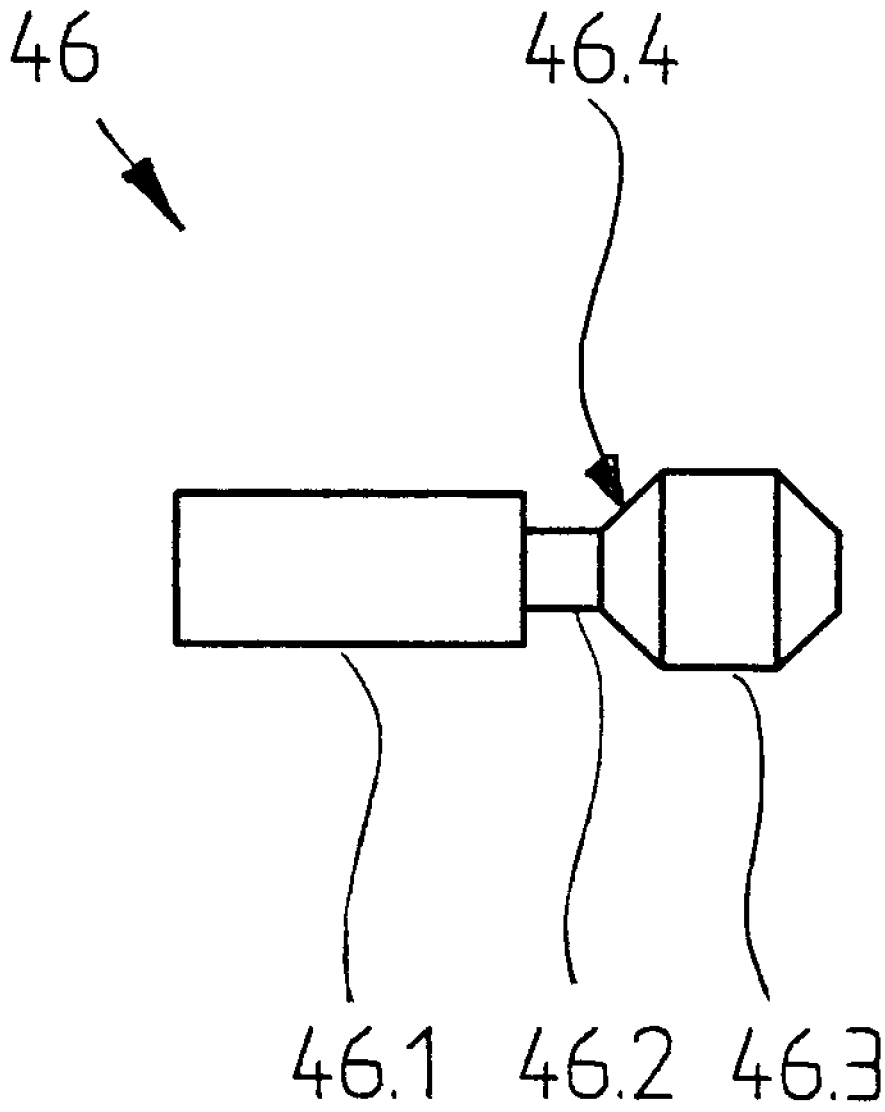
FIG. 5 shows a stud-shaped coupling element in side view.

FIG. 4 shows an embodiment example with a pass-through ring element 40" of shorter length. This leads to a reduction in moving mass of the robot 200. Otherwise, there are no differences from the previously described embodiment example according to FIGS. 3*a* through 3*c* during coupling and sealing.

The coupling of the robot hand 216 on the pass-through ring element 40 is explained by means of reference to FIGS. 3*a* through 3*c:*

In the initial position shown in FIG. 3*a*, the robot hand 216 is located within the pass-through ring element 40 inserted into the working chamber wall 110. The coupling receiver flange 50 on the robot hand 216 has already been passed over the coupling element 46. The pass-through ring element 40 is held in a defined position by means of the securing device with its centering elements 34 and the corresponding receiver elements 44.

Next, the locking elements 54 are passed over the coupling elements 46. The coupling receiver flange 50 with the gasket material 58 is pressed against the coupling flange of the pass-through ring element 40 by means of the oblique transition guide surface 46.4. Simultaneously, the fork-shaped receiver elements 54 engage in each slot of the coupling elements 46 so that a formed connection is produced between the robot hand 216 and the pass-through ring element 40.

The centering elements 34 are subsequently withdrawn so that the robot hand 216 with the pass-through ring element 40 may be moved within the sealing element 20. This condition is shown in FIG. 3*b*.

FIG. 3*c* shows a potential swinging of the robot hand 16. The work piece holder 220 consists essentially of a screw-clamp-type, U-shaped bail, on one end of which is provided with a displaceable clamping element 226, and on the other end of which includes a support element 222. Work pieces may be gripped between the clamping element 226 and the support element 222 that may be inserted into and withdrawn from the working chamber 100 through the pass-through ring element 40.

In the working chamber system based on the invention, the robot hand 216 may be moved as follows with retention of the seal created by the sealing element 20:

- Two-dimensional displacement of the robot hand 216 within the aperture 120;
- Translation movement into, and out of, the working chamber 100; and
- Swinging the robot hand 216 with the pass-through ring element 40 from a position perpendicular to the working chamber wall 110.

The working chamber system based on the invention is particularly suited to streaming processing of work material, i.e., sand-blasting or shot-peening, since a leak of blasting medium from the working chamber 100 is prevented by the formation of the seal based on the invention. Particularly in its tube-shaped, extended configuration shown in FIGS. 3*a* through 3*c*, the pass-through ring element 40 protects the robot hand 216 from direct impact of blasting particles in lateral streams. The area exposed to wear and blasted by medium is minimized for a screw-clamp configuration of the work piece holder 220.

Establishment and release of the coupling and the simultaneous sealing of the robot hand 216 and the pass-through ring element 40 may be accomplished very quickly by means of a pneumatic cylinder or similar, and may be performed by programmable control systems. Thus, it is possible during engine production, for example, to perform in-line blasting, i.e., to process the work piece before mounting without loss of time and without having to employ buffer bearings.

Figure 7:
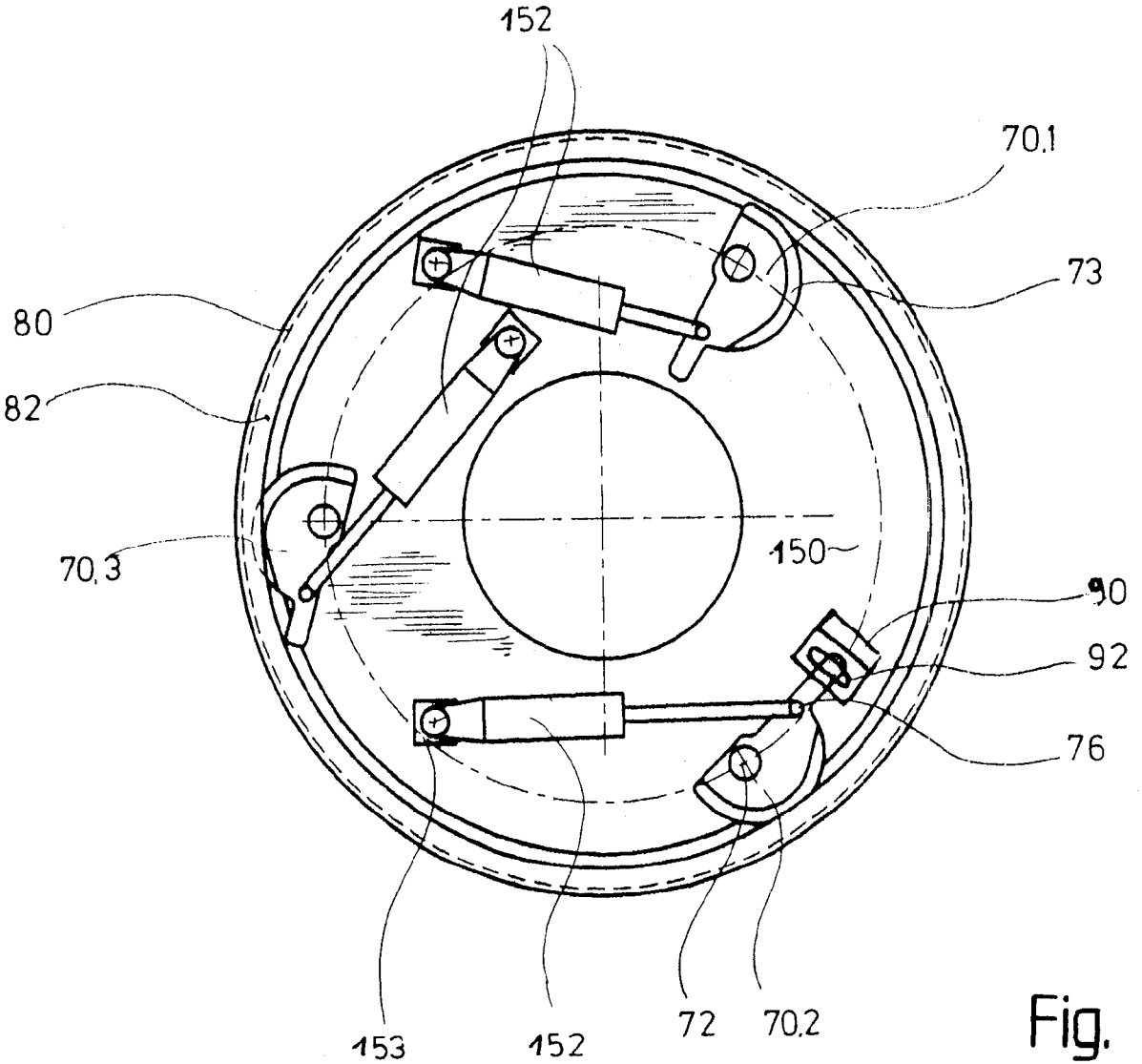
FIG. 7 shows still another embodiment of the sealing device according to the invention with swiveling locking elements in front view.

As FIG. 7 shows, the pass-through ring element 40 may also be provided with a complete or sectional collar edge element 80 positioned about its circumference. A shaped piece with U-shaped or L-shaped cross-section may be employed for this whereby an outer flank of the shaped piece of the collar edge 82 has its open end pointing inwards, i.e., toward the center of the pass-through ring element 40. The collar edge 82 is preferably provided with an oblique contact surface.

Three swing locking elements 70.1, 70.2, 70.3 to be attached to the robot hand are provided on a coupling receiver flange 50, each of which may be actuated by means of positioning elements 152. These positioning elements 152 are preferably in the form of pneumatic cylinders, and are connected on support bearings 153 with the coupling receiver flange 50 so that they may swivel. Additionally, they include on their other end a support bearing element by means of which a swiveling connection exists with the swivel locking elements 70.1, . . . , 70.3.

Figure 9:
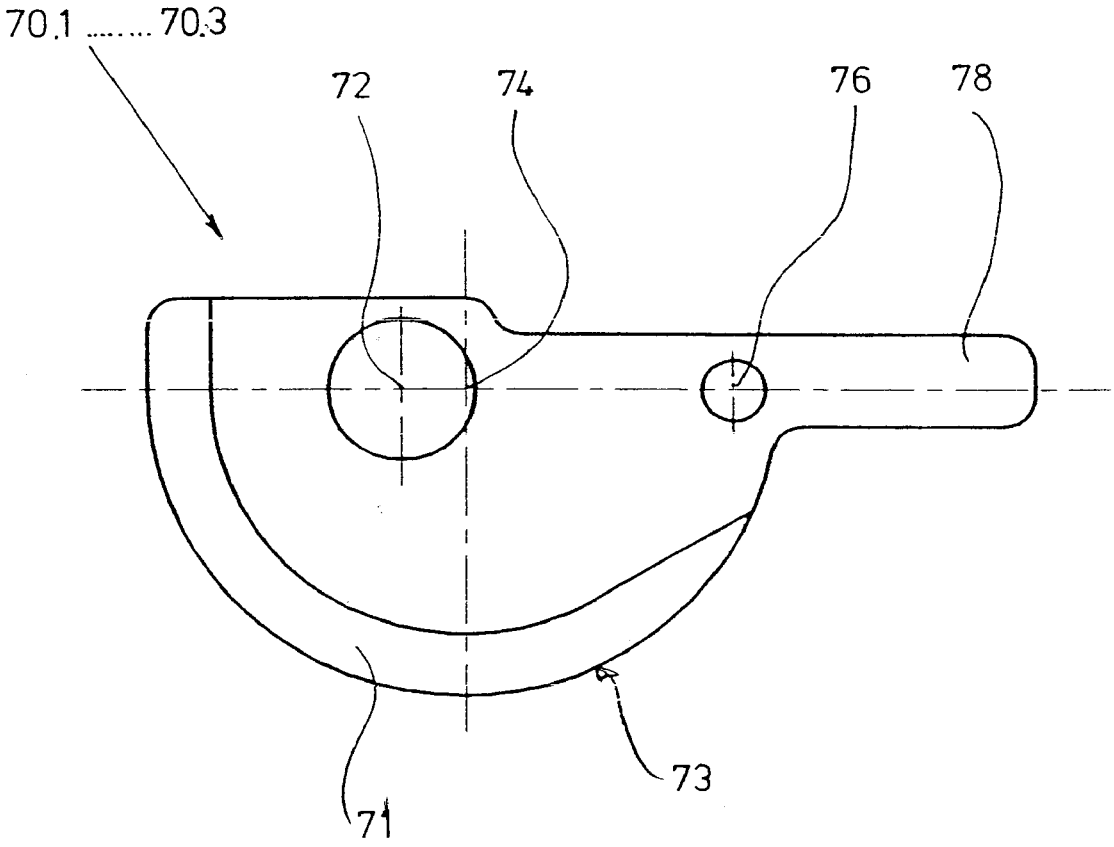
FIG. 9 is a front view of a swiveling locking element.
Figure 10:
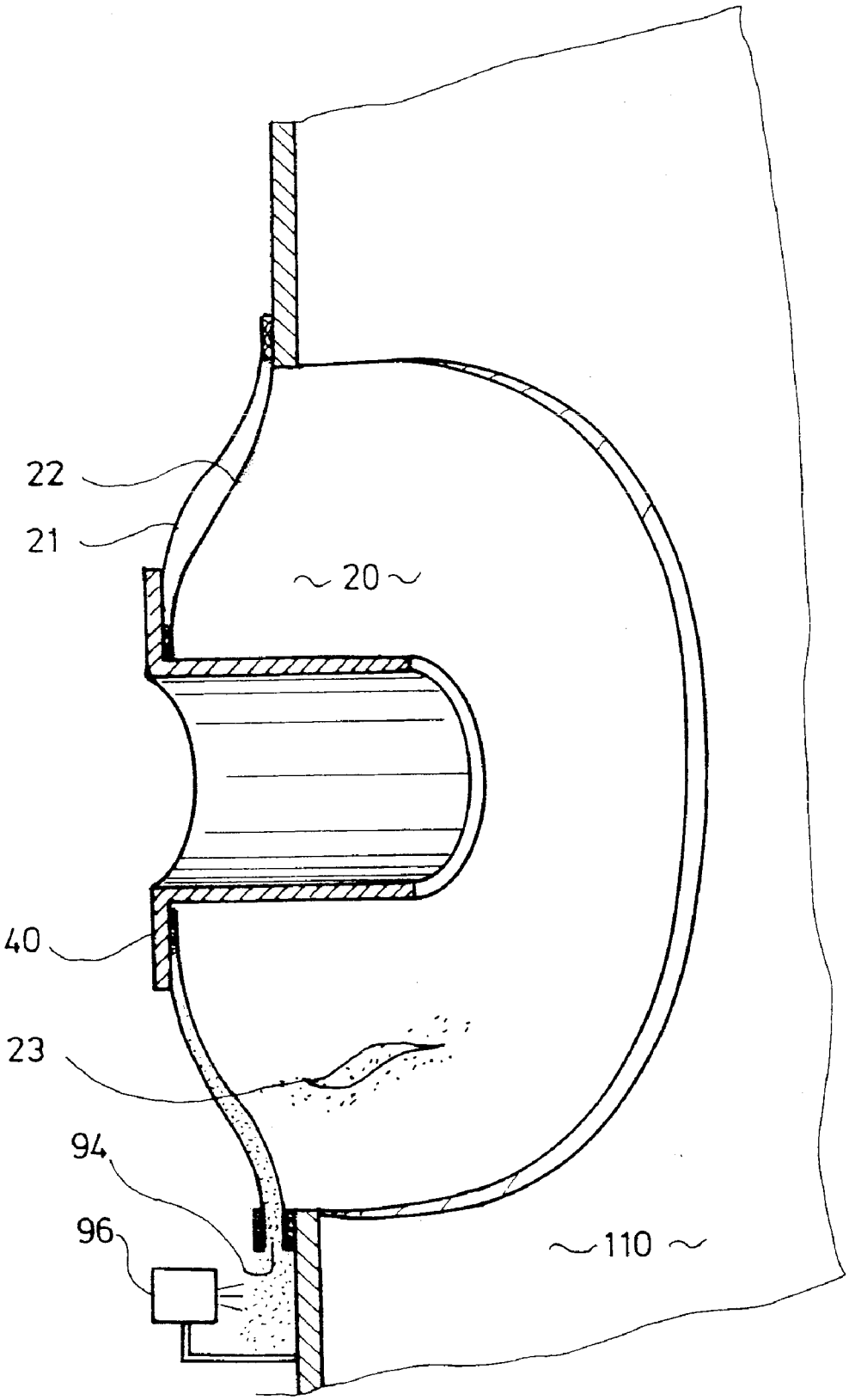
FIG. 10 is a perspective, cutaway view of still another embodiment of a sealing device according to the invention.

As FIG. 9 shows, the swivel locking elements 70.1, . . . , 70.3 are particularly in the form of approximately semi-circular disks, whereby an arc edge 73 is provided with an oblique guide 71. Each swivel locking element may rotate about a rotation point 72 that is preferably outside the symmetry axis 74 of the arc edge 73. This achieves the result that the arc edge 73 moves radially outward upon the swivel movement used to lock, thus increasing the locking effect. A contact point 76 for the support bearing element of the positioning element 70.1, . . . , 70.3 is positioned outside the symmetry axis 74 and rotation point 72. Also, the swivel locking element 70 is provided with a sensor vane 78 to determine position.

The eccentric contact point 76 may use, in particular, linear positioning elements 152. It is, however, also possible to allow a torque-creating positioning element directly at the rotation point 72.

In an initial position shown in the upper right of FIG. 7, the arc edge 73 of the swivel locking element 70.1 lies completely outside the collar edge 82. When the piston rod of the positioning element 52 is withdrawn, the swivel locking element 70.1 is then swiveled about the rotation point 72, whereby the arc edge 73 provided with an oblique guide 71 is moved under the collar edge 82 of the collar edge element 80 to the pass-through tube 40. This position is represented by the swivel lock element 70.2. The sensor vane 78 passes simultaneously under a sensor bracket element 90 to which known sensors are mounted in order to identify the position of the sensor vane 78 and thereby of the locking status of the swivel lock element. Such sensors are also preferably mounted on the swivel lock elements 70.1 and 70.2.

In general, a reliable seal and lock is achieved using three locking points. Depending on the diameter of the pass-through ring element 40, a lock and a seal may be achieved using fewer or more locking points.

At least two swivel lock elements with opposite directions of rotation are preferably distributed about the circumference. Thus, in FIG. 7, the swivel locking elements 70.1 and 70.1 are in mirror-reflected initial positions. This has the effect that, in case of a loosening of the lock, and thereby potential rotation of the entire coupling flange 50, a self-locking effect occurs. Regardless of the rotation direction of the loosened coupling flange 50, it presses one of the opposing swivel locking elements 70.1 and 70.1 under the collar edge 82.

As an additional optical monitoring option, the sensor holder element 90 may include an indicator aperture 92 in order to make the sensor vane visible when the swivel lock element 70.2 is located in the locking position.

In the position sketched with the swivel locking element 70.3, the arc edge 73 is completely moved under the collar edge 82, resulting in a tight friction connection between the pass-through ring element 40 and the coupling receiver flange 50. This locking is possible with a surrounding collar edge 82 at any angular relationship between the coupling receiver flange 50 and the swivel lock elements 70.1, . . . , 70.3. It is thus no longer required to bring the 6-axis articulated-arm robot 200 by means of its fourth axis 204, which is usually a rotation axis, into a particular angular position for the purpose of locking and sealing. Thus, the fifth axis 205, an articulating axis, may be swiveled into the working chamber 100 in a sealed and locked condition under any rotational orientation.

Figure 8:
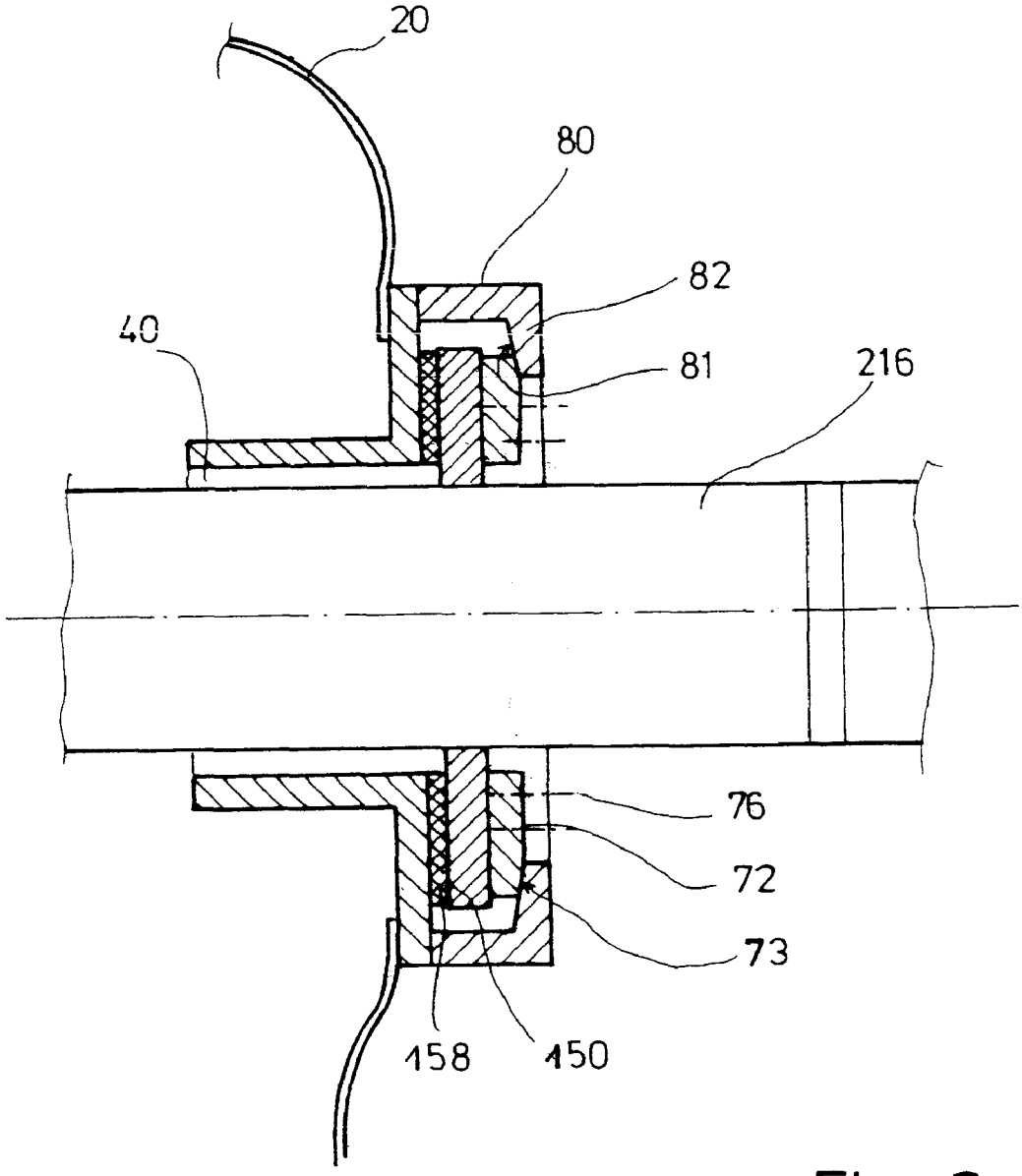
FIG. 8 is a schematic cutaway view of the locked sealing device according to FIG. 7.

FIG. 8 shows the lock status schematically in cutaway view. Upon engagement of the lock elements 70.1, . . . , 70.3 into the collar edge element 80, a seal is formed simultaneously between the robot hand 216 (not shown in detail in FIG. 8) and the pass-through ring element 40. For this, the coupling receiver flange 150 is at least partially covered with a flexible gasket material 158. The oblique contact surfaces 81, 71 on the swivel locking elements 70.1, . . . , 70.3 or on the collar edge 82 of the collar edge element 80 cause the coupling receiver flange 50 and the robot hand 216 connected with it to be pressed against pass-through ring element 40 upon insertion of the swivel locking elements 70.1, . . . , 70.3.

The shape of the work piece useable in the working chamber system based on the invention is almost unlimited, and is only restricted by the narrow width of the pass-through ring element, so that only minimum reconfiguration time is required.

There has thus been shown and described a novel working chamber system and seal integrity monitoring device which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. In a working chamber system comprising, in combination:

a working chamber wall with at least one aperture;

a robot hand inserted through the aperture into the working chamber; and a sealing device by means of which a seal of the aperture with the inserted robot hand may be established and removed by remote control;

the improvement wherein the sealing device includes:

(a) a flexible sealing element through which an inner pass-through ring element is connected with the edge of the aperture;

(b) at least two coupling elements attached to at least one of the pass-through ring element and the robot hand; and (c) at least one locking element connected to at least one of the robot hand and the pass-through element, which locking element may be brought into engagement with the coupling elements by means of positioning elements for the purpose of coupling the robot hand with the pass-through ring element.

2. Working chamber system as recited in claim 1, wherein the two coupling elements are attached to the pass-through ring element and the locking element is connected to the robot hand.

3. Working chamber system as recited in claim 1, wherein the two coupling elements are attached to the robot hand and the locking element is connected to the pass-through ring element.

4. Working chamber system as recited in claim 1, wherein the positioning elements are attached to a coupling receiver flange which is covered with a flexible gasket material.

5. Working chamber system as recited in claim 4, wherein the coupling receiver flange is wheel-shaped, and that it includes a hub section and a ring section that are connected by at least two spoke sections.

6. Working chamber system as recited in claim 1, wherein the coupling elements are in the form of studs that include a cylinder area and a front head area that are connected by means of a radial slot.

7. Working chamber system as recited in claim 6, wherein, in the coupling elements, at least the transition from the head area to the slot is provided with an oblique guide surface.

8. Working chamber system as recited in claim 6, wherein the positioning elements include locking elements with two parallel, separated fork arms between which the coupling element may be inserted with its slot.

9. Working chamber system as recited in claim 8, wherein the fork arms are provided with an oblique guide surface.

10. Working chamber system as recited in claim 6, wherein the locking element forms a bayonet mount and includes at least two locking recesses, each of which includes a stud pass-through recess and a stud locking recess associated with it.

11. Working chamber system as recited in claim 1, wherein the positioning elements are electromagnets, and that the coupling elements are in the form of ferromagnetic magnetic coupling areas.

12. Working chamber system as recited in claim 1, wherein the coupling elements are formed of at least one collar edge element that is attached at least by sections about the circumference of the pass-through ring element, and that includes a collar edge pointing toward the center point of the pass-through ring element, and wherein each of the locking elements may be brought into engagement with at least one collar edge element by means of positioning elements under the collar edge.

13. Working chamber system as recited in claim 12, wherein the collar edge element completely surrounds the pass-through ring element, and that the collar edge includes an oblique guide surface.

14. Working chamber system as in claim 12, wherein each of the coupling elements is in the form of a swivel locking element with an arc edge that includes an oblique guide surface, and that may be at least partially swiveled under the oblique guide surface of the collar edge.

15. Working chamber system as recited in claim 14, wherein the contact point of the positioning element on each swivel locking element is positioned eccentric to its rotation point.

16. Working chamber system as recited in claim 14, wherein the arc edge is in the form of a circular arc, and that the symmetry axis of the arc edge is offset from the rotation point of the swivel locking elements.

17. Working chamber system as recited in claim 12, wherein the locking elements are in the form of sliding locking elements that include oblique guide surfaces which may be moved at least partially under the collar edge.

18. Working chamber system as recited in claim 1, further comprising at least one securing device to secure the pass-through ring element in its initial position on the working chamber wall.

19. Working chamber system as recited in claim 18, wherein the securing device includes:

at least two actuator elements that are positioned opposite to the aperture with extendable pushrods;

centering elements mounted on the pushrods of the actuator elements; and receiver elements attached to the pass-through ring element to receive the centering elements in the initial position.

20. Working chamber system as recited in claim 19, wherein the actuator elements are pneumatic cylinders.

21. Working chamber system as recited in claim 1, wherein the ratio of the outer circumference of the pass-through ring element to the inner circumference of the aperture in the working chamber wall is 1:2 to 1:5.

22. Working chamber system as recited in claim 1, wherein the robot hand includes a work piece holder with a screw-clamp-type, U-shaped bail that is provided on its one end with a displaceable clamping element, and on its other end with a supporting element.

23. Working chamber system as recited in claim 1, wherein the pass-through ring element possesses a first sealing ring and the robot hand possesses a second sealing ring, by means of which a labyrinth seal is formed after the coupling of the pass-through ring element and the robot hand.

* * * * *